US005156279A

United States Patent [19]

Draghetti

[11] Patent Number: 5,156,279

[45] Date of Patent: Oct. 20, 1992

[54] PRODUCT FEEDING APPARATUS

[75] Inventor: Fiorenzo Draghetti, Bologna, Italy

[73] Assignee: G.D. Societá per Azioni, Bologna, Italy

[21] Appl. No.: 675,071

[22] Filed: Mar. 22, 1991

[30] Foreign Application Priority Data

Apr. 11, 1990 [IT] Italy ..... 3441 A/90

[51] Int. Cl.[5] ..... B07C 5/36; B65B 19/00

[52] U.S. Cl. ..... 209/654; 53/53; 798/370; 209/535; 209/919; 414/223

[58] Field of Search ..... 209/535, 654, 919, 536; 198/370; 414/223; 53/53, 54, 494

[56] References Cited

U.S. PATENT DOCUMENTS

| | | | |
|---|---|---|---|
| 3,517,477 | 6/1970 | Thornton | 209/535 X |
| 3,899,863 | 8/1975 | Seragnoli et al. | 53/53 |
| 4,238,025 | 12/1980 | Manservisi | 198/370 X |
| 4,559,758 | 12/1985 | Gamberini | 53/53 X |
| 4,814,072 | 3/1989 | Von Wichert et al. | 209/535 |
| 4,858,770 | 8/1989 | Gamberini | 209/535 |
| 4,874,076 | 10/1989 | Kaplan et al. | 198/370 |
| 5,101,609 | 4/1992 | Cook | 209/535 |

*Primary Examiner*—Donald T. Hajec
*Attorney, Agent, or Firm*—Ladas & Parry

[57] ABSTRACT

An apparatus (1) for feeding products, in particular packets of cigarettes (3) comprising a feeder (5) for feeding a succession of packets (2), a first conveyor (9) driven with intermittent motion and provided with seats (1) for receiving respective packets (2) from the feeder (5), and a receiver (3) for receiving the packets (2) from the first conveyor (9) in succession. The apparatus (2) also comprises a second conveyor (19) driven with intermittent motion and provided with seats (18) for containing respective packets (2), the path of travel of the seats (18) of the second conveyor (19) intersecting the path of travel of the seats (10) of the first conveyor (9) at a station (17) for the discarding and replacement of defective packets (2). During each of its stages of movement the second conveyor (19) is able to remove a defective packet (2) from a seat (10) of the first conveyor (9), and to introduce a sound packet (2) into the same seat (10).

5 Claims, 2 Drawing Sheets

PRODUCT FEEDING APPARATUS

TECHNICAL FIELD

This invention relates to a product feeding apparatus. In particular, the invention relates to an apparatus for replacing packets found to be defective in a cigarette packeting line. In the ensuing description reference will be made to the handling of packets of cigarettes, however the apparatus of the invention can be used for handling any type of product.

BACKGROUND OF THE INVENTION

As is well known, the packets of cigarettes produced on a packeting line are checked during their transit along the line to ensure that their shape is correct and that all their required component parts are present. Following these checks, any packets found to be defective are expelled from the packeting line at appropriate discarding stations, and are then replaced at a replacement station with sound packets, to maintain the continuity of succession of the conveyed packets. Maintaining this continuity is necessary to prevent problems arising at the subsequent working stations to which the packets are conveyed, in that for example the arrival of an incomplete group of packets at a subsequent working station would result in the inevitable discarding of the entire group.

Apparatus for replacing discarded defective packets with sound packets are known, for example from GB patent 2,021,082, in which the sound packets to be fed into a conveying line to replace the missing packets are contained in one or more stores, from which transfer means extract the packets in succession as required. Such apparatus are however considerably bulky, complicated and costly, because of the presence of said stores and the transfer means for extracting the packets from the stores.

In addition, the packets have to be periodically loaded into the said stores by an operator, which means that a person must be assigned to periodically check the degree of filling of the stores and to fill them manually.

SUMMARY OF THE PRESENT INVENTION

The object of the present invention is to provide a completely automatic apparatus for replacing defective packets in a packeting line, which is free of the aforesaid drawbacks of the known art, and which is therefore simple, economical and of small overall size.

This object is attained according to the present invention by an apparatus for feeding products, comprising feeder means for transporting a succession of products, a first conveyor driven with intermittent motion and provided with a plurality of seats for receiving respective products from said feeder means at an entry station, and receiver means for receiving said products in succession from said first conveyor at an exit station.

The invention a second conveyor driven with intermittent motion and having a plurality of seats for containing respective products, and reversible motor means for driving said second conveyor, the path of travel of the seats of said second conveyor intersecting the path of travel of the seats of said first conveyor at a station for the discarding and replacement of defective products. The movement of said first conveyor taking place during halt stages of said second conveyor.

The movement of said second conveyor taking place during halt stages of said first conveyor, the second conveyor being able, during each of its stages of movement in a first direction of advancement through said discarding and replacement station, to remove a defective product from a seat of said first conveyor and retain it in a first seat of said second conveyor, and to introduce into the same seat of said first conveyor a sound product contained in a second seat of said second conveyor adjacent to said first seat.

BRIEF DESCRIPTION OF THE DRAWINGS

The present invention is described hereinafter with reference to the accompanying drawings, which illustrate a non-limiting example thereof and in which.

DETAILED DESCRIPTION

Figure 1:
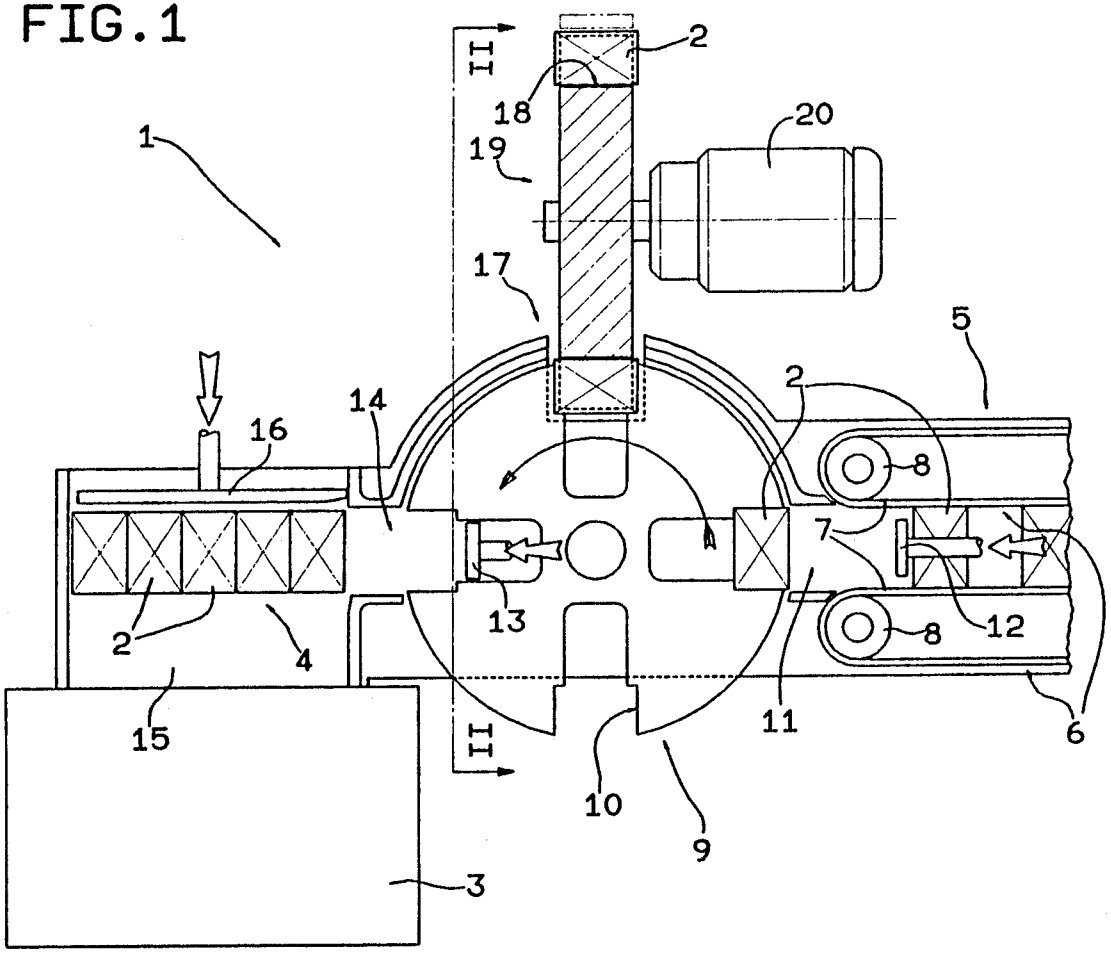
FIG. 1 is a schematic plan view of an apparatus constructed in accordance with the present invention in a first operating position.

In FIG. 1 the reference numeral 1 indicates overall an apparatus for transferring products, such as packets 2 of cigarettes, between a delivery unit, not shown, consisting for example of a wrapping machine for wrapping the finished packets 2 of cigarettes in a sheet of transparent material, and receiver means comprising a receiving unit 3 consisting for example of a packaging machine for cartoning groups 4 of packets 2 in a sheet of cartoning material (not shown).

The apparatus 1 comprises a feeder means consisting of a conveyor unit 5 starting at the exit of said delivery unit and comprising two parallel and mutually facing belt conveyors 6 spaced apart by a distance equal to the longitudinal dimension of a packet 2 of cigarettes and each consisting of an endless belt 7 extending about a pair having a rollers 8 (only one of which is shown) of vertical axis.

At the exit end of the conveyor unit 5 there is a facing conveyor comprising a transfer wheel 9 having a vertical axis, provided peripherally with a plurality of radially equidistant seats or compartments 10 and driven with intermittent rotary motion in an counterclockwise direction, with reference to FIG. 1, by motor means not shown.

During respective halt stages of the wheel 9 the conveyor unit 5 conducts the packets 2 in succession into respective compartments 10 at an entry station 11, corresponding to the region of substantial tangency between the exit end of the conveyor unit 5 and the wheel 9, by the cooperation of a pusher element 12 of known type driven with reciprocating motion. Said packets 2 are extracted in succession from the compartments 10 by a pusher element 13 of known type at an exit station 14 diametrically opposite the station 11. The pusher element 13 pushes the packets onto an inlet table 15 of the cartoning machine 3, to form groups 4 of packets 2 which rest against each other along their smaller lateral faces. The groups 4 are urged in succession by a pusher element 16 towards the cartoning line (not shown) of the machine 3.

At a discarding and replacement station 17, in which one compartment 10 is positioned at each halt stage of the wheel 9, the path of travel of the compartments 10 is intersected by the path of travel of the seats or compartments 18 of a conveyor comprising a wheel 19 having a horizontal axis parallel to the direction of extension of the conveyor unit 5, provided peripherally and equidistantly with a plurality of such compartments 18 and driven with intermittent rotary motion by reversible motor means 20.

More precisely, when the wheels 9 and 19 are in their halt stage, the wheel 9 has a compartment 10 coinciding with a compartment 18 of the wheel 19, the halt and movement stages of the two wheels 9 and 19 being such as to prevent any mutual interference between these wheels, as the wheel 9 can undergo rotational steps only when the wheel 19 is at rest and vice versa.

Figure 2:
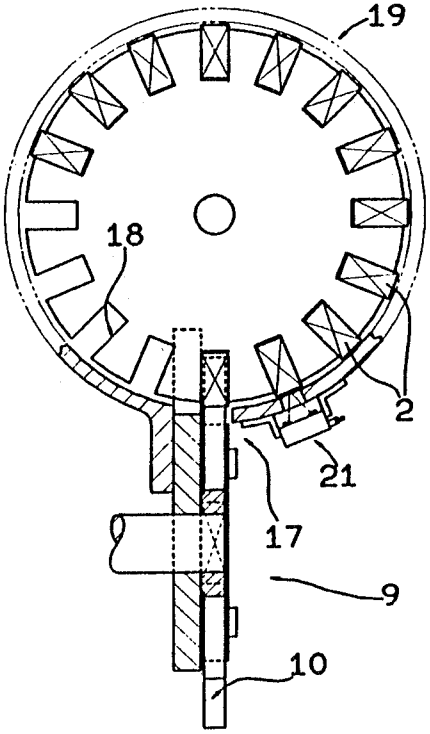
FIG. 2 is a schematic elevation of the apparatus of FIG. 1.

The reference numeral 21 indicates an optical sensor device of known type (see FIG. 2) able to sense whether the compartments 18 of the wheel 19 are full or empty.

When the apparatus 1 is in use under normal operating conditions, the wheel 19 is at rest and a certain number of its compartments 18 internally contain respective packets 2. An empty compartment 18 remains at rest in the discarding and replacement station 17 during the rotational steps of the wheel 9, as stated.

The packets 2 are transferred in succession by the conveyor unit 5 into the compartments 10 of the wheel 9 at the station 11, and are conducted by said wheel 9, by means of rotational steps in a counterclockwise direction (FIG. 1), through said empty compartment 18 and towards the station 14, in which the pusher element 16 pushes them onto the table 15, as stated.

When a packet 2 is found to be defective, control means of known type, not shown, positioned upstream of the apparatus 1 operate the motor means 20 in such a manner as to cause the wheel 19, on arrival of the defective packet 2 at the station 17 during a halt stage of the wheel 9, to undergo a clockwise rotation step (FIG. 2) such that the defective packet 2 is seized from the compartment 10, at rest in the station 17, by a compartment 18 of the wheel 19, and a sound packet 2 contained in the adjacent compartment 18 is led into the compartment 10 which has been freed of the defective packet 2. Extractor means of known type, not shown, then remove the defective packet 2 from the compartment 18 and feed it towards a collection container, not shown. During the course of successive rotation steps of the wheel 9 the sound packet 2 fed into a compartment 10 of the wheel 9 is conducted towards the station 14 and deposited on the table 15, so that the continuity of the succession of packets 2 fed to the cartoning machine 3 is not interrupted.

The described operation involving the replacement of defective packets conveyed by the wheel 9 can be repeated a determined number of times before the compartments 18 of the wheel 19 are all empty. When this situation occurs, the optical sensor 21 senses the fact that all the compartments 18 of the wheel 19 are empty, and operates the motor means 20 in the opposite direction to that already considered, to cause the wheel 19, in synchronism with the rotation steps of the wheel 9, to undergo a number of steps sufficient to fill all the compartments 18 with packets from the compartments 10 of the wheel 9 which successively halt at the station 17. In other words, after activation of the motor means 20, a compartment 18 at rest in the station 17 receives a packet 2 from a compartment 10 which has arrived at the station 17, and removes said packet 2 from said compartment 10 when the wheel 19 undergoes a counterclockwise rotation step (see FIG. 2). The wheel 19 undergoes a further rotation step to bring to the station 17 a further packet 2, which is seized by a compartment 18 of the wheel 19, and so on. After a certain number of rotation steps of the wheel 19, all its compartments 18 have been filled with that number of packets 2, the fact that all the compartments 18 of the wheel 19 are now full being sensed in known manner by the sensor device 21 or other checking means of known type, not shown, the motor means 20 then being halted, the wheel 19 then being again ready to deliver sound packets into the compartments 10 of the wheel 9 in the aforesaid manner.

During the described stage in which the compartments 18 of the wheel 19 are filled, no packet 2 is fed onto the table 15, and the cartoning machine 3 undergoes one or more idle cycles, in that the pusher element 16 undergoes a feed stroke without encountering a group 4 of packets 2 on the table 15. Inhibition means of known type, not illustrated or described as they do not form part of the apparatus according to the present invention, halt the feed of cartoning material to the cartoning machine 3 during said idle cycle.

Within the principle of the invention, numerous modifications can be made to the described apparatus without leaving the scope of the inventive idea.

Figure 3:
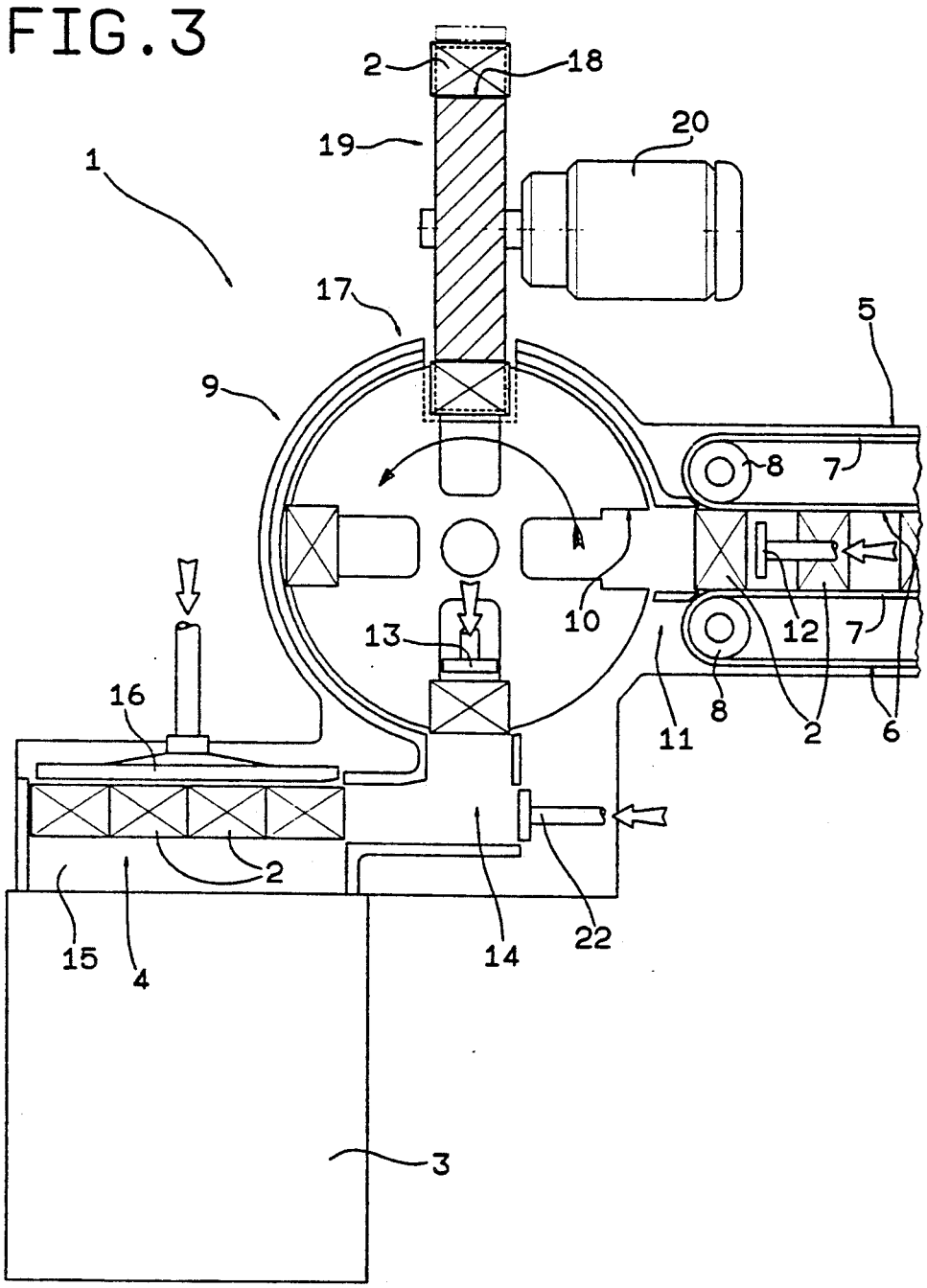
FIG. 3 is a schematic plan view of the apparatus of FIGS. 1 and 2 in a further operating position.

For example, according to a modification shown in FIG. 3, the table 15 of the cartoning machine 3 adjoins the wheel 9 at an exit station 14 diametrically opposite the station 17, with reference to the axis of the wheel 9. The exit station 14 is angularly offset from the entry station 11 by an angle equal to 90° or 270° in the illustrated example. The packets 2 which on leaving the compartments 10 are to be arranged in succession on the table 15 are urged by a pusher element 22 onto said table 15 along a direction parallel to the direction of extension of the conveyor unit 5, to form groups 4 of packets 2 abutting against each other. Finally, it should be noted that the wheel 9 can have any number of compartments 10, and said stations 14 and 17 could be arranged angularly offset from the entry station 11 by different amounts than so far considered, but with the obvious condition that the station 17 must precede the station 14, with reference to the direction of rotation of the wheel 9.

From the aforegoing it is apparent that the described apparatus 1 enables packets 2 found defective in a cartoning line to be replaced in a completely automatic manner, in accordance with the stated object, and that it does not suffer from the described drawbacks of the known art, being simple, economical, and of small overall size.

I claim:

1. An apparatus for feeding products, comprising feeder means (5) for transporting a succession of products (2), a first conveyor (9) driven with intermittent motion and provided with a plurality of seats (10) for receiving respective products (2) from said feeder means (5) at an entry station (11), receiver means (3) for receiving said products (2) in succession from said first conveyor (9) at an exit station a second conveyor (19) driven with intermittent motion and provided with a plurality of seats (18) for containing respective products (2), and reversible motor means (2) for driving said second conveyor (19), the path of travel of the seats (18) of said second conveyor (19) intersecting the path of travel of the seats (10) of said first conveyor (9) at a station (17) for the discarding and replacement of defective products (2), the movement of said first conveyor (9) taking place during halt stages of said second conveyor (19), and the movement of said second conveyor

(19) taking place during halt stages of said first conveyor (9), said second conveyor (19) being able, during each of its stages of movement in a first direction of advancement through said discarding and replacement station (17), to remove a defective product (2) from a seat (10) of said first conveyor and retain it in a first seat (18) of said second conveyor, and to introduce into the same seat (10) of said first conveyor (9) a sound product (2) contained in a second seat (18) of said second conveyor adjacent to said first seat (18), wherein the sound products (2) are inserted into determined compartments (18) of said second conveyor (19) during successive movements of the second conveyor (19) in the opposite direction to said first direction of advancement.

2. An apparatus as claimed in claim 1, wherein said first and second conveyor comprise wheels (9, 19) provided in their periphery with respective equidistant seats (10, 18) for receiving respective products (2), the axes of said wheels being normal to each other.

3. An apparatus as claimed in claim 2, wherein said exit station (14) is diametrically opposite said entry station (11), with reference to said first conveyor (9).

4. An apparatus as claimed in claim 2, wherein said exit station (14) is angularly offset from said entry station (11), with reference to said first conveyor (9), by an angle of 90°.

5. An apparatus as claimed in claim 2, wherein said exit station (14) is anglely offset frcm said entry station (11) with reference to said first conveyor (9) by an angle of 270°.

* * * * *